US005351959A

United States Patent [19]

Duffy

[11] Patent Number: 5,351,959

[45] Date of Patent: Oct. 4, 1994

[54] GOLF CLUB

[76] Inventor: Thomas Duffy, 33 Poplar Drive, Parkhall, Clydebank, United Kingdom, G81 3PL

[21] Appl. No.: 50,297

[22] PCT Filed: Nov. 15, 1991

[86] PCT No.: PCT/GB91/02019

§ 371 Date: Jun. 30, 1993

§ 102(e) Date: Jun. 30, 1993

[87] PCT Pub. No.: WO92/08521

PCT Pub. Date: May 29, 1992

[30] Foreign Application Priority Data

Nov. 17, 1990 [GB] United Kingdom ..... 9025045
Apr. 2, 1991 [GB] United Kingdom ..... 9106843

[51] Int. Cl.[5] ..... A63B 53/08; A63B 69/36
[52] U.S. Cl. ..... 273/170; 273/171
[58] Field of Search ..... 273/167 R, 167 F, 169, 273/170, 171, 77 R, 193 R, 194 R

[56] References Cited

U.S. PATENT DOCUMENTS

| | | | |
|---|---|---|---|
| 1,894,841 | 1/1933 | Adams | 273/170 |
| 2,432,450 | 12/1947 | Sears | 273/171 |
| 3,037,775 | 6/1962 | Busch | 273/170 |
| 3,516,673 | 6/1970 | Estes | 273/170 |
| 3,993,314 | 11/1976 | Harrington | 273/170 |
| 4,541,631 | 9/1985 | Sasse | 273/170 |
| 4,715,606 | 12/1987 | Varley | 273/170 X |
| 5,082,279 | 1/1992 | Hull | 273/170 |

FOREIGN PATENT DOCUMENTS

| | | | |
|---|---|---|---|
| 2167966 | 6/1986 | United Kingdom . | |
| 2200560 | 8/1988 | United Kingdom | 273/171 |

*Primary Examiner*—Theatrice Brown
*Assistant Examiner*—Sebastiano Passaniti
*Attorney, Agent, or Firm*—Sixbey, Friedman, Leedom & Ferguson

[57] ABSTRACT

A golf club is disclosed which comprises a hollow shaft and a club head, at least a portion of which is hollow and in communication with the hollow shaft. A portion of the shaft defining a reservoir to carry a supply of fluent weight material in a valve for permitting the flow of the weight material into and out of the club head for changing the weight of the club head.

6 Claims, 6 Drawing Sheets

GOLF CLUB

FIELD OF THE INVENTION

THIS INVENTION relates to golf clubs and, more particularly, to a weight-adjustable golf club head.

BACKGROUND OF THE INVENTION

When playing golf, it is desirable to select a golf club which has playing characteristics best suited to the shot to be played, e.g. a lofted club to lift the ball from the rough or to pitch the ball onto a green. However, having selected the correct club, the playing conditions on the day may affect the shot played; eg in wet conditions, a heavier weighted club head would produce the same resulting shot as a lighter club head in fine conditions.

The rules of golf as published by The Royal and Ancient Club of ST.Andrews are very precise on the nature of implements that are used for playing golf. Many features of a golf club may not be altered within the rules. The only characteristic of a golf club that may be altered within these rules is the weight of a golf club.

There are some known golf clubs which have attempted to incorporate a weight-adjustment means as a feature of the club either by providing replaceable inserts of different weights or a series of washers for securing to the head by eg a polygonal pin Key.

These items for weight adjustment require physical removal or addition, also the exercise is time consuming and requires care. The present invention aims to obviate, or mitigate the above disadvantages associated with the above described clubs.

SUMMARY OF THE INVENTION

According to one aspect of the present invention there is provided a golf club comprising a hollow shaft and a club head, at least a portion of which is hollow and in communication with the hollow shaft, a portion of the shaft defining a reservoir to carry a supply of fluent weight material, the head being baffled to restrict movement of weight during play and means to permit the flow of weight material into or out of the club head for changing the weight of the club head characterised in that the head of the club is formed in two sections, the baffle being provided on one of the sections.

Conveniently, the means for changing the weight of the club comprises a valve control means mounted within the shaft below the reservoir.

Preferably, the valve control means comprises a plurality of valve members provided in an off-set relationship and a switching means to alter the relative positions of the valve members to allow a measured amount of weight material selectively introduced into or removed from the head of the club.

Preferably, a locking means is provided to ensure that unauthorised weight change during play cannot take place.

An embodiment of the present invention will now be described, by way of example, with reference to the accompanying Figures in which:

DESCRIPTION OF THE PREFERRED EMBODIMENTS

Figure 1:
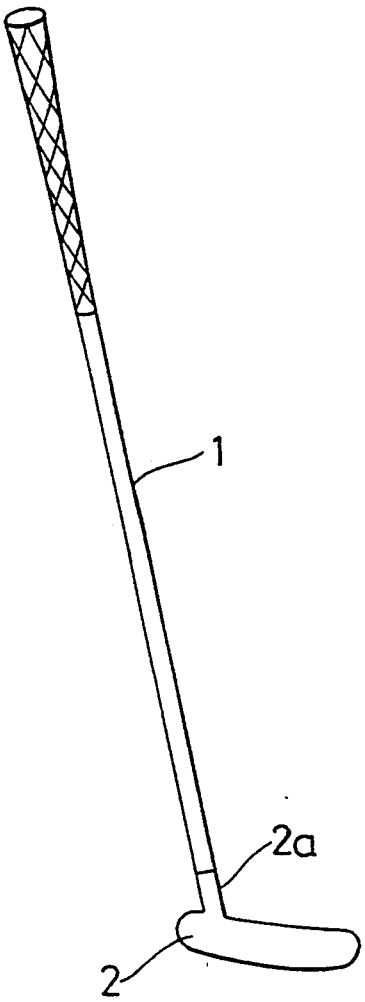
FIG. 1 is a schematic view of a golf club according to one aspect of the present invention.

Referring now to the drawings, a golf club according to one aspect of the invention comprises a hollow shaft 1 having a hollow head 2 mounted thereon. The head 2 my be mounted on the shaft 1 by any suitable means, via the neck or socket 2*a* of the head.

Figure 2:
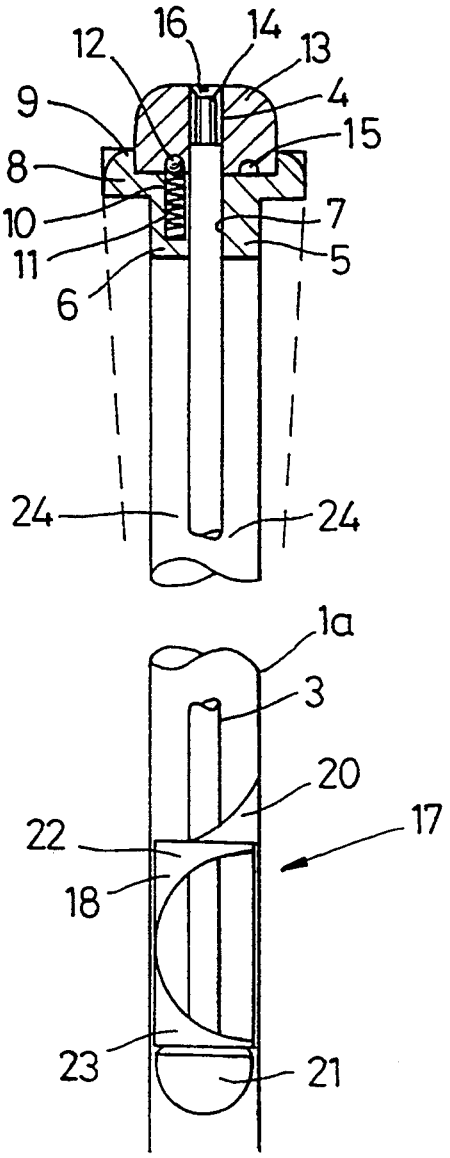
FIG. 2 is a part sectional view of an upper portion of the golf club of FIG. 1.

FIG. 2 shows a part sectional view of an upper portion of the hollow shaft 1 of the club. A rod 3 extends axially within the upper portion 1*a* of the shaft 1. The upper end of the rod 3 has a square cross section and a threaded bore 4 which extends axially through the upper end of the rod. A stopper 5 is mounted in the upper end of the rod 3.

The stopper 5 has a sleeve portion 6 which has a diameter which is slightly smaller than the diameter of the upper portion of the shaft 1*a* to allow the sleeve portion 6 to be introduced into the upper portion of the shaft.

An axial bore 7 extends through the sleeve portion 6 of the stopper, the diameter of the bore 7 being slightly greater than the diameter of the rod 3 to allow the rod to be introduced into the bore 7.

A lip portion 8 overhangs the sleeve portion 6 and the upper portion of the shaft 1*a* of the club when the stopper 5 has been inserted into the shaft 1*a* of the club.

The upper surface 9 of the lip portion 8 of the stopper 5 is provided with a circular recess 10 adjacent the bore 7 extending through the stopper. A spring 11 is seated in the circular recess 10 and a ball bearing 12 is mounted on the free end of the spring 11.

A switch means 13 is mounted on the stopper 5. The switch means has an aperture 14 passing axially therethrough. The aperture has a substantially square cross-section and corresponds to the cross section of the upper end of the rod 3. The underside of the switch means 13 is provided with a plurality (in this case four) of circular recesses 15 which correspond in size to the recess 10 in the upper surface 9 of the stopper 5.

A suitable fixing means such as a screw 16 passes through the aperture 14 in the switch means 13 and into the threaded bore 4 of the rod 3 and secures the switching means to the rod 3. This effectively traps the spring and ball-bearing arrangement 11,12 under tension between the switching means 13 and the stopper 5. The spring 11 is located in the recess 10 in the surface of the stopper 5 and the ball-bearing 12 is located in one of the recesses 15 of the switching means The upper surface of the switching means may be provided with indicating means to show the different positions of the switching means. For example, a series of colour-coded dots (not shown) may be used to identify the recess 15 in which the ball-bearing 12 is located at any one time.

The lower portion of the rod 3 extends into a valve control means 17 of the club. The valve control means comprises a hopper barrel 18 which has a diameter which is slightly smaller than that of the shaft 1 to allow the hopper barrel to be mounted within the shaft 1 in a close fit.

A first valve member 20 is fixedly mounted in the upper portion of the hopper barrel 18. The first valve member 20 is substantially semi-circular, with a chambered upper surface. A second valve member 21, substantially identical to the first valve member is fixedly mounted in the lower portion of the hopper barrel 18. The second valve member 21 is mounted an 90 degrees to the first valve member 20. The rod 3 passes through each of the first and second valve members 20, 21 in freely rotational relationship.

Third and fourth valve members 22,23 are provided in spaced relationship within the hopper barrel 18 between the first and second valve members 20,21. The third and fourth valve members 22,23 are freely rotatable within the hopper barrel 18 and are fixedly mounted on the rod 3

The third and fourth valve members 22,23 are substantially three-quarter discs, each having a chamfered upper surface and are mounted on the rod 3 in the same orientation.

A reservoir 24 is defined between the stopper 5 and the hopper barrel 18.

Figure 3:
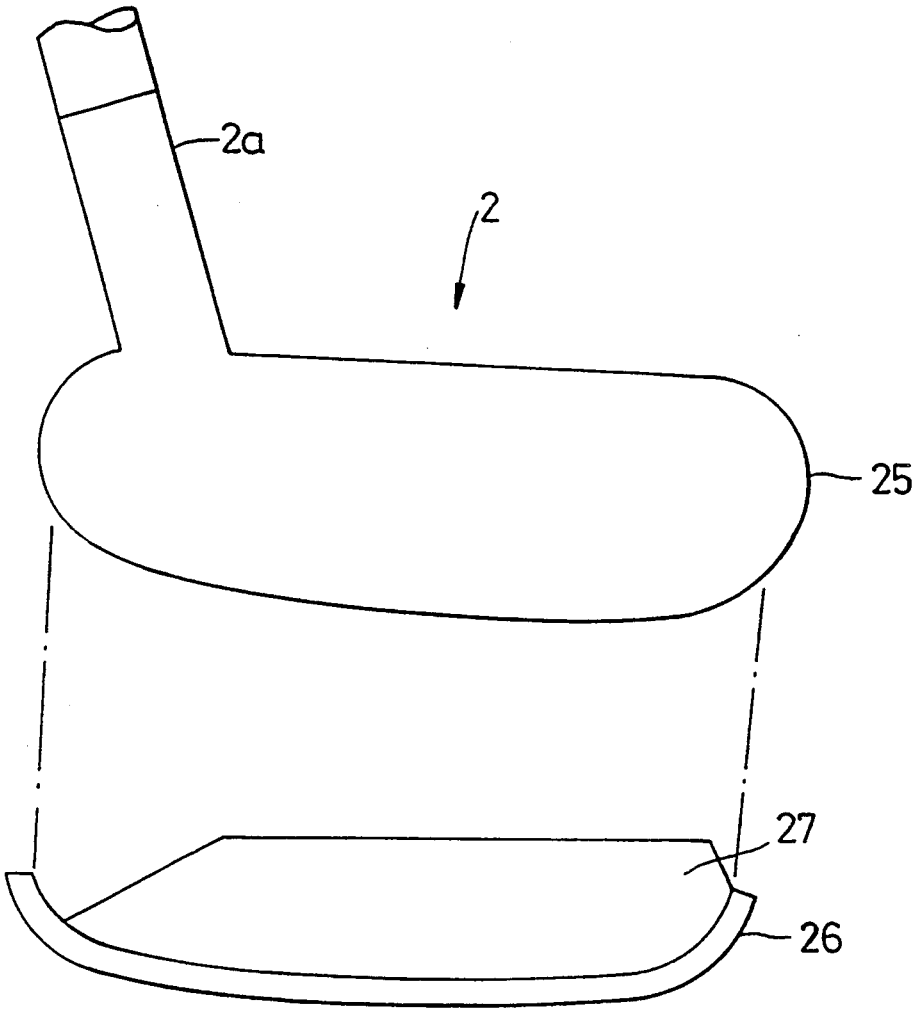
FIG. 3 is an exploded view of the club head of FIG. 1
Figure 4:
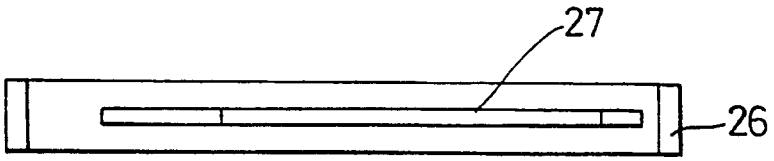
FIG. 4 is a plan view of the base of the club head of FIG. 3.

Turning now to FIG. 3, this shows an exploded view of the head 2 of the club according to one aspect of the present invention. The head of the club is formed of a two-piece construction comprising a hollow head portion 25, here shown as the head of a putter and a base portion or sole 26. The base portion 26 of the head is provided with one or more baffles 27 (one of which is shown) which run along the centre of the base as shown in FIGS. 3 and 4.

Figure 5:
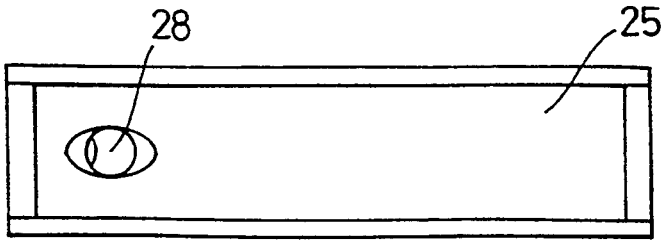
FIG. 5 is an underneath view of the club head of FIG. 3.

FIG. 5 shows a view from underneath the head portion 25. An aperture 28 is provided adjacent one end of the head portion. The area of the head portion 25 surrounding the aperture 28 is chamfered on each side.

In order to make the golf club as described above, the head 3 of the club is cast in two parts from a suitable material and the base 26 of the club is inserted into the underside of the hollow head portion 25 and secured in position, e.g. by welding. The head 2 of the club is mounted onto a hollow shaft 1 as described above.

The valve control means 17 and the rod 3 are mounted into the hollow shaft 1 at an appropriate height within the shaft. The reservoir 24 is filled with an appropriate weighting material, for example finely ground lead shot.

The stopper 5 is fitted over the upper potion of the rod 3 and inserted into the open end of the shaft 1. The spring 11 and ball bearing 12 are mounted on the stopper 5 and the switch means 13 is secured over the stopper 5 by passing the screw 16 through the aperture 14 in the switch means and the bore 7 in the stopper 5 and into the threaded bore in the upper end of the rod 3.

It is envisaged that the reservoir 24 will hold 60 grammes of wight material and that the hopper barrel 18 will hold 12 grammes of material, therefore allowing weight increments of 12 grammes to be added to the club head. It is to be understood that the increments could be altered by providing a relatively larger or smaller hopper barrel within the shaft.

The use of the golf club wall now be described. The normal weight of the club head 2 is when empty. If it is desirous to increase the weight of the club head the golfer first starts with the club head 25 empty. The switch means 13 is set in the neutral position wherein the weight material in the reservoir is not permitted into the hopper barrel 18 by the overlapping first and third valve members 20,22 as shown in FIG. 6.

Figure 7:
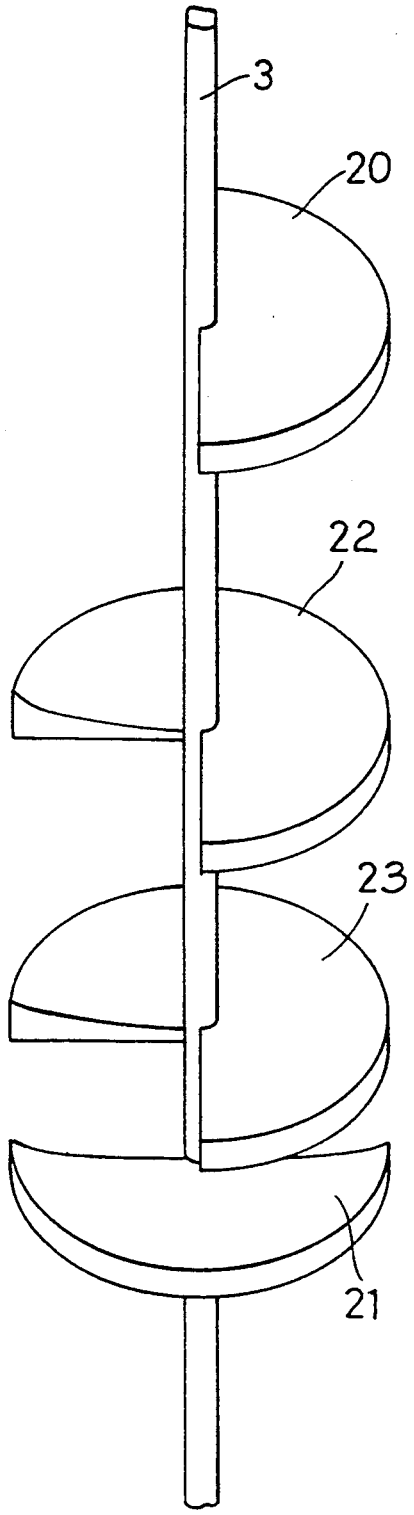

The switch means 13 is then rotated to a first load position. As the switch means is rotated, the rod 3 in turn rotates, thus rotating the third and fourth valve members 22,23. In the load position as shown in FIG. 7 weight from the reservoir 24 above the hopper barrel 18 is allowed to flow into the hopper, past the first and third valve members 20,22, but, as the second valve member 21 is at 90 degrees to the first valve member 20, the weight is held within the hopper barrel 18 by the overlapping fourth and second valve members 23,21.

Figure 6:
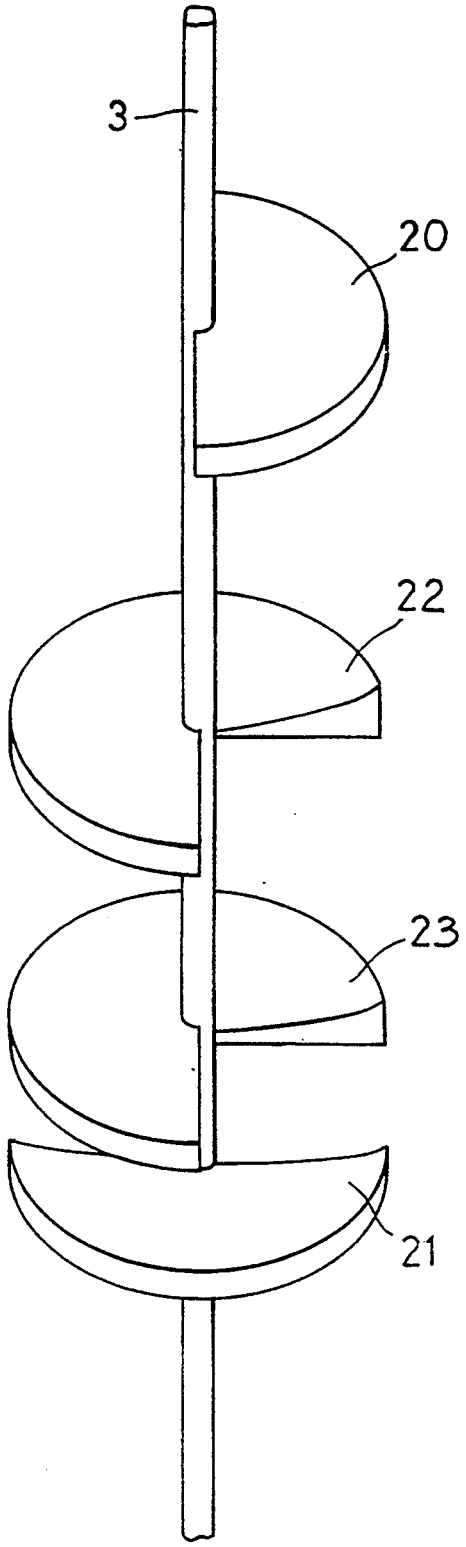
FIGS. 6–9 are views of the control valve means of the club of FIG. 1.

The switch means 13 is then moved back to the neutral position as shown in FIG. 6 which prevents further weight from flowing into the hopper barrel and also prevents the weight stored in the hopper barrel from flowing out down the hollow shaft 1 of the club.

Figure 8:
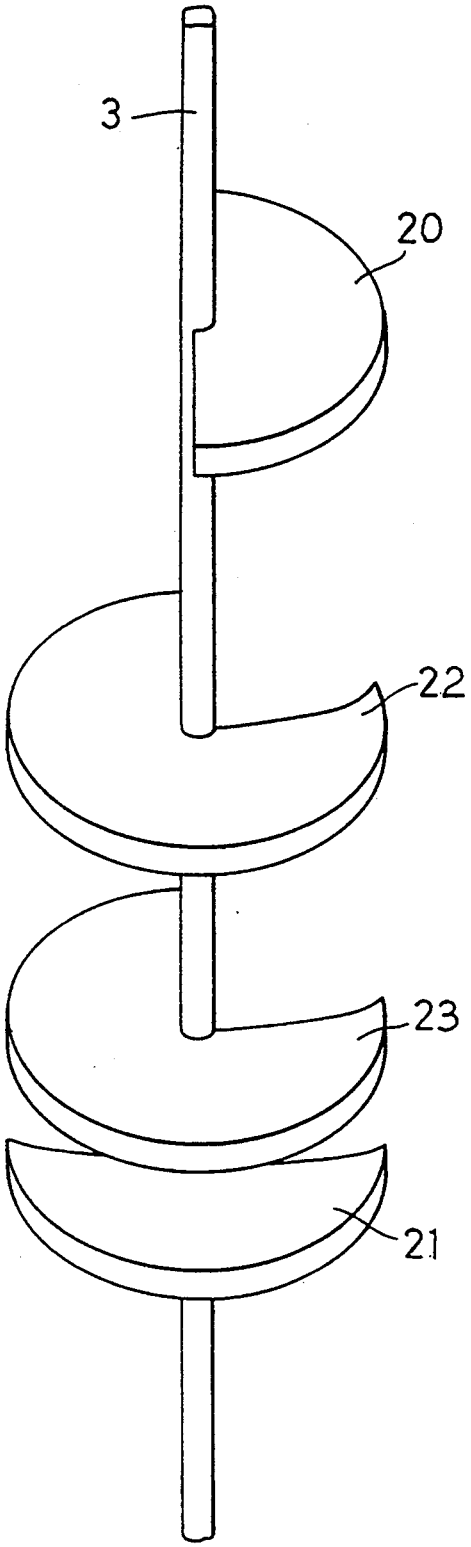

When a measured amount of weight is required in the head 2 of the club, the switch means 13 is moved to a drop position as shown in FIG. 8. The reservoir 24 is sealed from the valve control means 17 by the overlapping first and third members 20,22 but the second and fourth members 21,13 no longer overlap and the weight stored in the hopper barrel 18 is allowed to fall through the shaft 1 and into the hollow head portion 25. If further weight is required in the head of the club the switch means 13 is passed through neutral to the load position, through neutral once more and on to the drop position. This action can be repeated as often as is necessary to produce the correct weight of club head.

Figure 9:
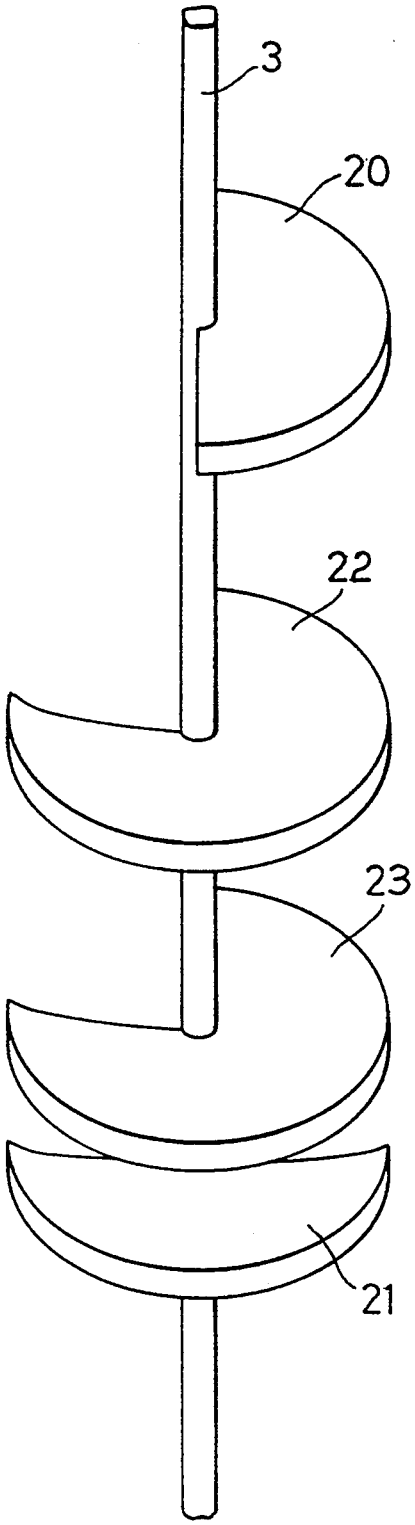

In the event that the player wishes the weight of the club head no be increased to the maximum weight in one operation, the switch means 13 is moved to the dump position as shown in FIG. 9 and all of the weight in the reservoir 24 is allowed to pass through the hopper barrel 18 into the hopper and into the head 25 of the club.

At any time, the weight of the club head can be returned to normal by moving the switch means 13 to the dump position (FIG. 9) thereby opening a passage through the shaft 1 from the reservoir 24 to the head of the club and tuning the club upside down to allow the weight to flow back through the shaft to the reservoir above the hopper 18. The chamfered edge surrounding the aperture 28 in the hollow head portion 25 encourages the weight to flow out of the hollow head of the club with the minimum amount of manipulation by the golfer.

It is to be understood that while playing a shot with a golf club as described above, the weight introduced into the head of the club is prevented from moving within the club by the baffle 27. Thus, the loose weight within the club head does not affect the shot to be played.

Rule 4(1)(a) prohibits weight change of a club head during play, so it is suggested that a player practices with the club before commencement of play and adjusts the weight of the club head to suit that days conditions.

Figure 10:
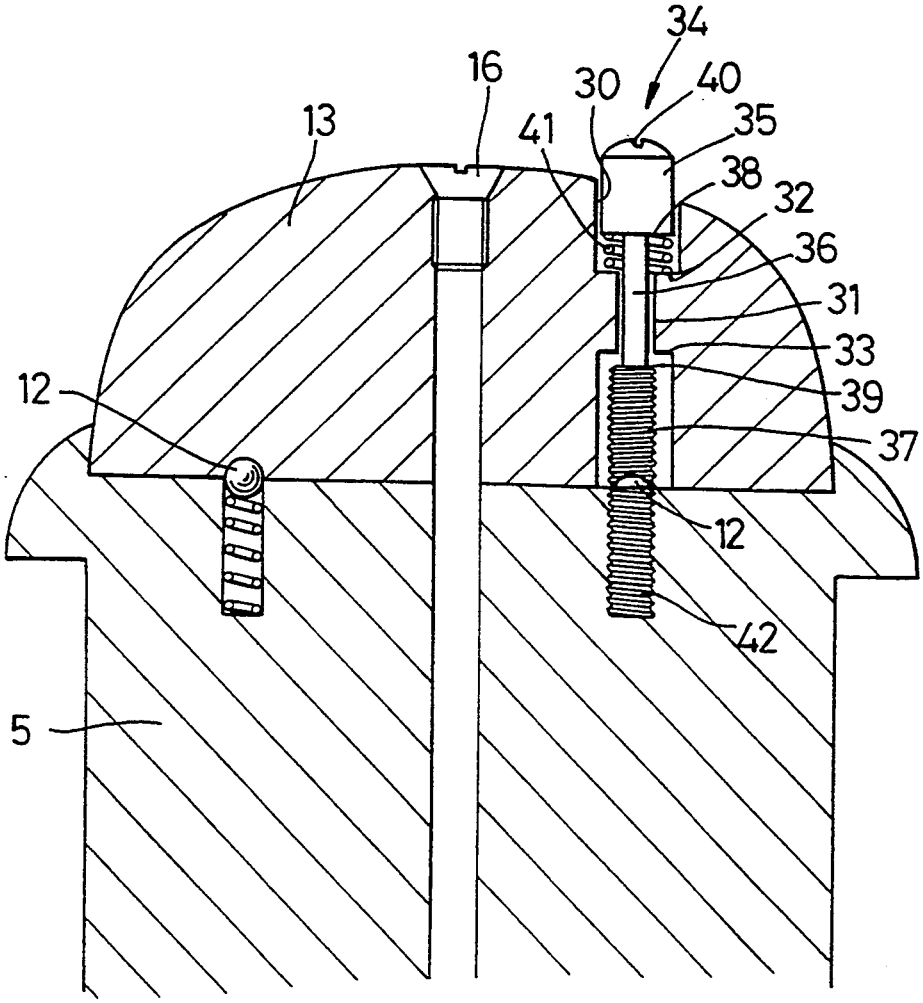
FIG. 10 is a cross-section of the upper portion of a club according to one aspect of the present invention in an un-locked condition.
Figure 11:
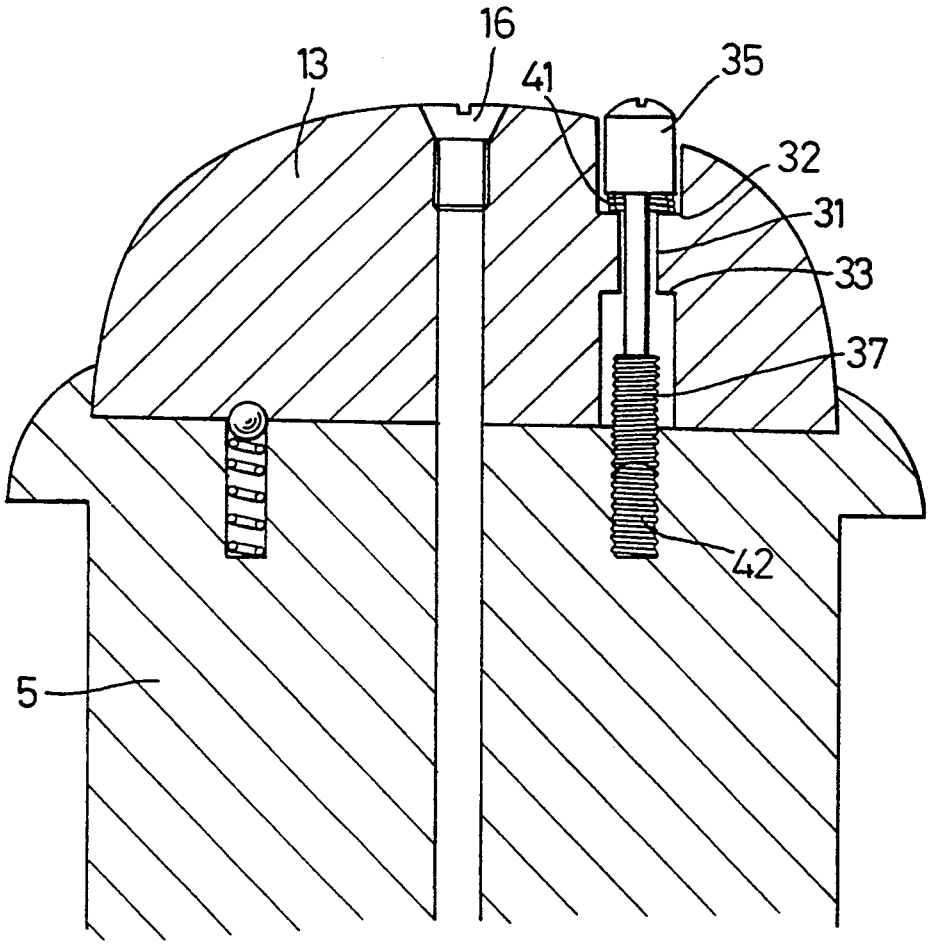
FIG. 11 is a cross-section of the upper portion of the club of FIG. 10 in a locked condition.

Security means my be provided to ensure that unauthorised weight change during play cannot take place. One example of such a device is shown in FIGS. 10 and 11 wherein a profiled bore 30 is provided which extends through the switching means 13 of the club. The bore 30 has a region of reduced diameter 31 which forms two abutment surfaces 32,33, one at either end of the reduced diameter region.

A plunger 34 extends within the bore 30, the plunger having a head 35, a region of reduced diameter 36 and a threaded shank 37. The region of reduced diameter 36 of the plunger 34 forms a shoulder 38,39 with each of the head 35 and shank 37 of the plunger.

The head 35 of the plunger is provided with a slot 40 to allow a driving member (not shown) such as a screw driver to engage the plunger 34 and rotate the plunger within the bore 30.

A resilient member 41 which in this example is shown to be a coiled spring is provided between the shoulder 38 of the head 35 of the plunger and the upper abutment surface 32 of the bore 30, thus biasing the plunger 34 into the position shown in FIG. 10 where the head of the plunger clearly projects from the switching mane 13 and thus indicates that the weight change mechanism of the club is in the un-locked condition and my be changed by the method described above.

The end of the threaded shank of the plunger is recessed to allow the shank of the plunger to act as one of the indentations 12 in the switching means when the locking means is in the un-locked condition.

A threaded bore 42 which is slightly larger in diameter than the threaded shank 37 of the plunger is provided in the upper surface of the stopper to receive the threaded shank 37 when the club is to be locked against further weight change.

In this condition, the head 35 of the plunger is screwed down to the switching means 13 and the threaded shank 37 of the plunger is screwed into the threaded bore 42, thus preventing further turning of the switching means 13 to change the weight of the head of the club.

The driving member for the screw my conveniently be provided in the form of a key ring to be carried by the golfer.

The head of the plunger my be coloured to highlight to other golfers that the club is in an un-locked condition.

I claim:

1. A golf club comprising a hollow shaft and a club head, at least a portion of which is hollow and in communication with the hollow shaft, a portion of the shaft defining a reservoir to carry a supply of fluent weight material, the head being baffled to restrict movement of weight during play and means to permit the flow of weight material into or out of the club head for changing the weight of the club head wherein the head of the club includes a base portion and a head portion with said baffle being provided in one of said portions and extending in a substantially longitudinal direction of the head of the club.

2. A golf club according to claim 1 wherein the means for changing the weight of the club head comprises a valve control means mounted within the shaft below the reservoir.

3. A golf club according to claim 2 wherein the valve control means comprises a plurality of valve members provided in an off-set relationship and a switching means to alter the relative positions of the valve members to allow a measured amount of weight material to be selectively introduced into or removed from the head of the club.

4. A golf club according to claim 1, wherein a locking means is provided to prevent an unauthorized change in the weight of the club head during play.

5. A golf club comprising a hollow shaft and a club head, at least a portion of which is hollow and in communication with the hollow shaft, a portion of the shaft defining a reservoir to carry a supply of fluent weight material, the head being baffled to restrict movement of weight during play and means to permit the flow of weight material into or out of the club head for changing the weight of the club head including a valve control means mounted within the shaft below the reservoir, wherein the valve control means comprises a plurality of valve members provided in an offset relationship and a switching means to alter the relative positions of the valve members to allow a measured amount of weight material to be selectively introduced into or removed from the head of the club, the head having a base portion and head portion with said baffle being provided in one of said portions.

6. A golf club according to claim 5, wherein a locking means is provided to prevent an unauthorized change in the weight of the club head during play.

* * * * *